US005730110A

United States Patent [19]

Nelson et al.

[11] Patent Number: 5,730,110

[45] Date of Patent: Mar. 24, 1998

[54] BI-MODAL AIR ASSIST INJECTION SYSTEM

[75] Inventors: Brian J. Nelson, Royal Oak; Sandra N. Thomson, Rochester Hills; Gregory J. Dykstra, Grosse Pointe Wood, all of Mich.

[73] Assignee: Chrysler Corporation, Auburn Hills, Mich.

[21] Appl. No.: 727,160

[22] Filed: Oct. 7, 1996

[51] Int. Cl.[6] ..... F02M 23/00

[52] U.S. Cl. ..... 123/588

[58] Field of Search ..... 123/585, 588

[56] References Cited

U.S. PATENT DOCUMENTS

| | | | |
|---|---|---|---|
| 5,129,381 | 7/1992 | Nakajima | 123/585 |
| 5,211,148 | 5/1993 | Furuya et al. | 123/585 |
| 5,409,169 | 4/1995 | Saikalis et al. | 239/404 |

OTHER PUBLICATIONS

S. Albu, J. Wong, "Technologies for Meeting Ultra–Low–Emissions Levels," SAE Paper 94C012.

*Primary Examiner*—Noah P. Kamen

*Attorney, Agent, or Firm*—Mark P. Calcaterra

[57] ABSTRACT

The present invention provides an apparatus for controlling air flow within an internal combustion engine comprising a secondary air passage. The secondary air passage system includes an air inlet channel directing air flow to the air assist valve and an air outlet channel directing air flow from the air assist valve. The air outlet channel communicates with a plurality of fuel injector tips which are disposed within the engine. An air bypass circuit is interposed between the air inlet channel and the air outlet channel to provide an alternate air channel which is independent of the air assist valve. An engine controller electronically communicates with the air assist valve for causing the air assist valve to vary between its open and closed modes.

12 Claims, 3 Drawing Sheets

BI-MODAL AIR ASSIST INJECTION SYSTEM

BACKGROUND OF THE INVENTION

1. Technical Field

This invention generally relates to fuel injection systems for internal combustion engine and, more particularly, to a system for introducing air at a fuel injector tip for increasing the atomization of fuel and decreasing the level of hydrocarbon and carbon monoxide emissions.

2. Discussion

As is generally known in the art of internal combustion engines, elevated levels of hydrocarbon and carbon monoxide emissions are produced at cool engine temperatures. At times, including engine start-up, the hydrocarbon and carbon monoxide emissions levels may approach government imposed maximum levels. By running the engine at a leaner fuel/air mixture, that is, at reduced enrichment, more desirable emission output levels can be achieved.

In conventional engines, a single air flow path is provided to the engine intake ports. The volume of air flow through the intake ports is controlled by a throttle plate disposed in a throttle body and a pintle disposed in an idle air duct bypassing the throttle communicating with the intake ports. The volume of air in the system can be controlled by varying the throttle plate or the pintle position to adjust the amount of air permitted to pass through or around the throttle body. It has now been found that a secondary air flow path leading directly to the fuel injectors can be used to increase the atomization of fuel and provide improved emissions.

Previous attempts to provide a secondary air flow path have used a source of compressed air to direct secondary air flow. However, this method requires the very complex task of pulsing the fuel and secondary air source simultaneously. Thus, any advantage gained by this method is offset by its difficult implementation and associated expense.

Other secondary air path systems have attempted to use a dual pintle automatic idle speed motor. The first pintle routes air to the air injectors while the second pintle controls air flow to the manifold. However, this method is not as effective as the present invention and sacrifices automatic idle speed motor efficiency.

Thus, there is a need for a bi-modal air assist injection system which introduces air at the injector tip through a secondary pathway which does not require compressed air, simultaneous pulsing or sacrificing automatic idle speed motor efficiency.

SUMMARY OF THE INVENTION

The above and other objects are provided by an apparatus for controlling air flow within an internal combustion engine comprising a secondary air passage.

The secondary air passage system includes an air inlet channel directing air flow to an air assist valve and an air outlet channel directing air flow from the air assist valve. The air outlet channel communicates with a plurality of fuel injector tips which are disposed within the engine. An air bypass circuit is interposed between the air inlet channel and the air outlet channel to provide an alternate air channel which is independent of the air assist valve. An engine controller electronically communicates with the air assist valve for causing the air assist valve to vary between its open and closed modes.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
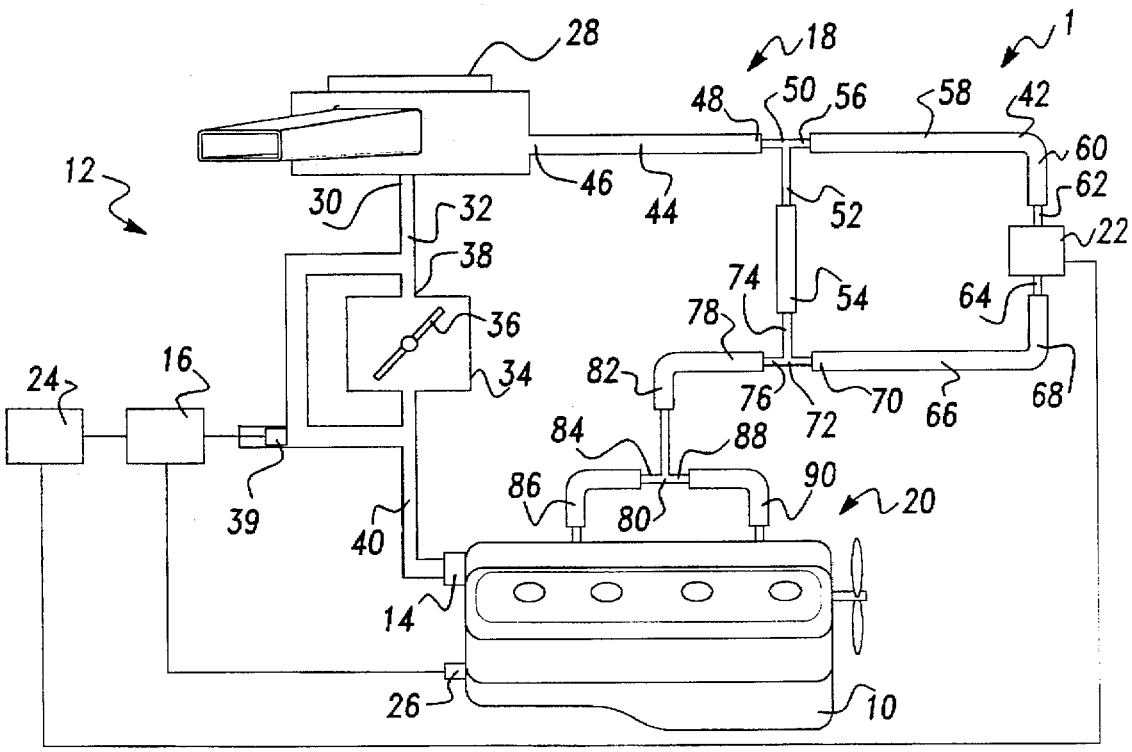
FIG. 1 is a schematic illustration of a bi-modal air assist injection system according to the present invention.

In FIG. 1, a bi-modal air assist injection system for increasing the atomization of fuel at the fuel injector tips implementing the present invention is shown generally at 1. As is known in the art of internal combustion engines, the level of hydrocarbon and carbon monoxide emissions during cold engine operation can be reduced by operating at a leaner fuel/air mixture. The present invention provides a means for lowering the level of hydrocarbon and carbon monoxide emissions during engine operation by increasing the atomization of fuel. The present invention alleviates the expense and complexity required to achieve lower levels of hydrocarbon and carbon monoxide emissions according to the prior art and improves emissions without sacrificing fuel economy.

Still referring to FIG. 1, the bi-modal air assist injection system 1 is shown. An internal combustion engine 10 includes a primary air flow passage 12 for directing air from the atmosphere to a plurality of intake ports, represented by intake port 14, within the engine 10. An idle air control motor 16 is operably coupled with the primary air flow passage 12 for varying the volume of air passing therethrough.

A secondary air flow passage 18 communicates with the engine 10 for directing air flow to a plurality of fuel injectors, represented by the injector 20, for increasing the atomization of fuel. A valve 22 is disposed on the secondary air flow passage 18 for regulating the volume of air flow passing therethrough.

An engine controller 24 electronically communicates with the valve 22 and the idle air control motor 16. The engine controller 24 coordinates the volume of air flow permitted to pass through each of the primary and secondary air flow passages 12, 18. The controller 24 also electronically communicates with a coolant temperature sensor 26. The sensor 26 sends a signal which is interpreted in the controller 24 for an indication of when a threshold coolant temperature has been reached or exceeded. If the threshold temperature has been reached or exceeded, an air flow routing variation is prompted.

An air cleaner 28 is disposed at a proximal end 30 of an air cleaner duct 32 of the primary air flow passage 12 to filter contaminants from atmospheric air. A throttle housing 34 including a movable throttle blade on plate 36 located therein is disposed at a distal end 38 of the air cleaner duct 32 for regulating the volume of air passing through the primary air flow passage 12. An engine duct 40 of the primary air flow passage 12 is disposed between the throttle housing 34 and the engine 10.

The idle air control motor 16 actuates a pintle 39 which controls airflow through a bypass duct to the engine duct 40 independent of the throttle blade 36 position. The engine controller 24 electronically communicates with the idle air control motor 16 for controlling the position of the pintle 39.

The secondary air flow passage 18 includes an air inlet channel 42 having a first section 44 coupled at a first end 46 to the air cleaner 28. The first section 44 is coupled at a second end 48 to a coupler 50 for dividing the air flow. The coupler 50 is connected at a first outlet 52 to a bypass section 54 and at a second outlet 56 to a second section 58 of the inlet channel 42. The second section 58 of the inlet channel 42 is coupled at an exit end 60 to an inlet port 62 of the air assist valve or solenoid 22. The solenoid 22 is coupled at an outlet port 64 to a first section 66 of an outlet channel system 68.

The first section 66 of the outlet channel system 68 is coupled at an exit end 70 to a second coupler 72. The second coupler 72 is secured at a first end 74 to the bypass section 54 and at a second end 76 to a second section 78 of the outlet channel system 68. It should be noted that the bypass section 54 contains a predetermined-diameter orifice which provides the desired airflow bypass. The second section 78 of the outlet channel system 68 is coupled to a third coupler 80 at an exit end 82. The third coupler 80 is connected at a first end 84 to a first delivery channel 86 and at a second end 88 to a second delivery channel 90.

The solenoid 22 electronically communicates with the engine controller 24 for causing open and closed modes of the secondary air flow passage system 18. As is described in greater detail below, in an open mode, air travels through the inlet channel system 42, through the solenoid 22 and through the outlet channel system 68 to the injectors 20. In a closed mode, air is prevented from travelling through the solenoid 22 and therefore must travel through the bypass section 54 and to the injectors 20 at a reduced volume.

Figure 2:
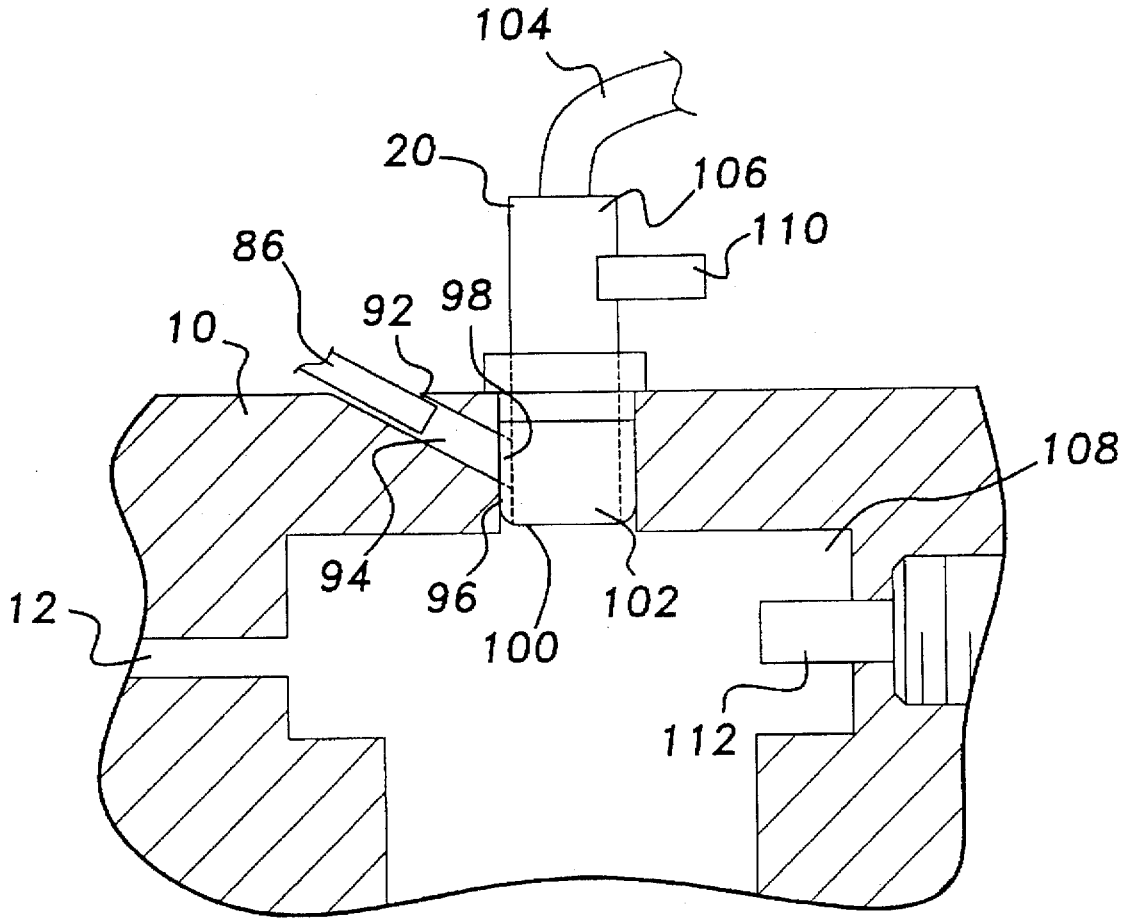
FIG. 2 is a schematic view of a secondary air flow pathway at an injector tip according to the present invention.

With reference to FIG. 2, an exit end 92 of the first delivery channel 86 is shown communicating with a passage 94 integrally formed in the engine 10. The passage opens into a pocket 96 wherein the fuel injector 20 is disposed. When the fuel injector 20 is properly aligned, an aperture 98 in a shroud 100 surrounding the fuel injector tip 102 lines up with the passage 94. In this way, air flowing through the first delivery channel 86 is transferred through the passage 94 to the injector tip 102 through the shroud 100. It should be noted that although only the first delivery channel 86 has been described, a plurality of delivery channels may be utilized. Additionally, a plurality of apertures 98 can be provided in the shroud 100 to communicate with a plurality of passages 94 in the engine 10 for multi-directional or increased air flow.

A fuel line 104 delivers fuel to an entrance end 106 of the fuel injector 20 for injection into a combustion chamber 108. An electronic coupling 110 is provided on the injector 20 for receiving signals to initiate an injection sequence. Fuel is injected into the combustion chamber 108 after passing through the shroud 100 where it is atomized by introduced air from the solenoid 22 or bypass line 54. The atomized fuel combines with air from the primary air flow passage 12 for combustion by a spark plug 112 or other conventional means.

Upon turning an ignition key to an "on" position, an initial reading of the coolant temperature is requested from the sensor 26, which continuously monitors the coolant temperature by the engine controller 24. If the temperature of the coolant is below a threshold level, preferably in the range of 150° F. or lower, the engine controller 24 sends a pulse width modulated signal to the solenoid 22 commanding it to switch to an open mode. Upon receiving the signal, the solenoid 22 changes from a closed mode to an open mode. As stated previously, air flow through the solenoid 22 is prevented and is forced to travel at a reduced volume through the bypass section 54 in a closed mode. However, in an open mode, air is permitted to travel through the solenoid 22 at a greater volume.

The engine controller 24 also sends a signal commanding a modified position of the pintle 39 to the idle air control motor 16 corresponding to the signal sent to the solenoid 22. Upon receiving the signal, the idle air control motor 16 adjusts the position of the pintle 39 a calibrated amount to compensate for the air flow passing through the secondary air flow passage 18. In this way, a controlled volume of air is flowing through the bi-modal air assist injection system 1 regardless of the particular routing through the primary or secondary air flow passages 12, 18.

Figure 3:
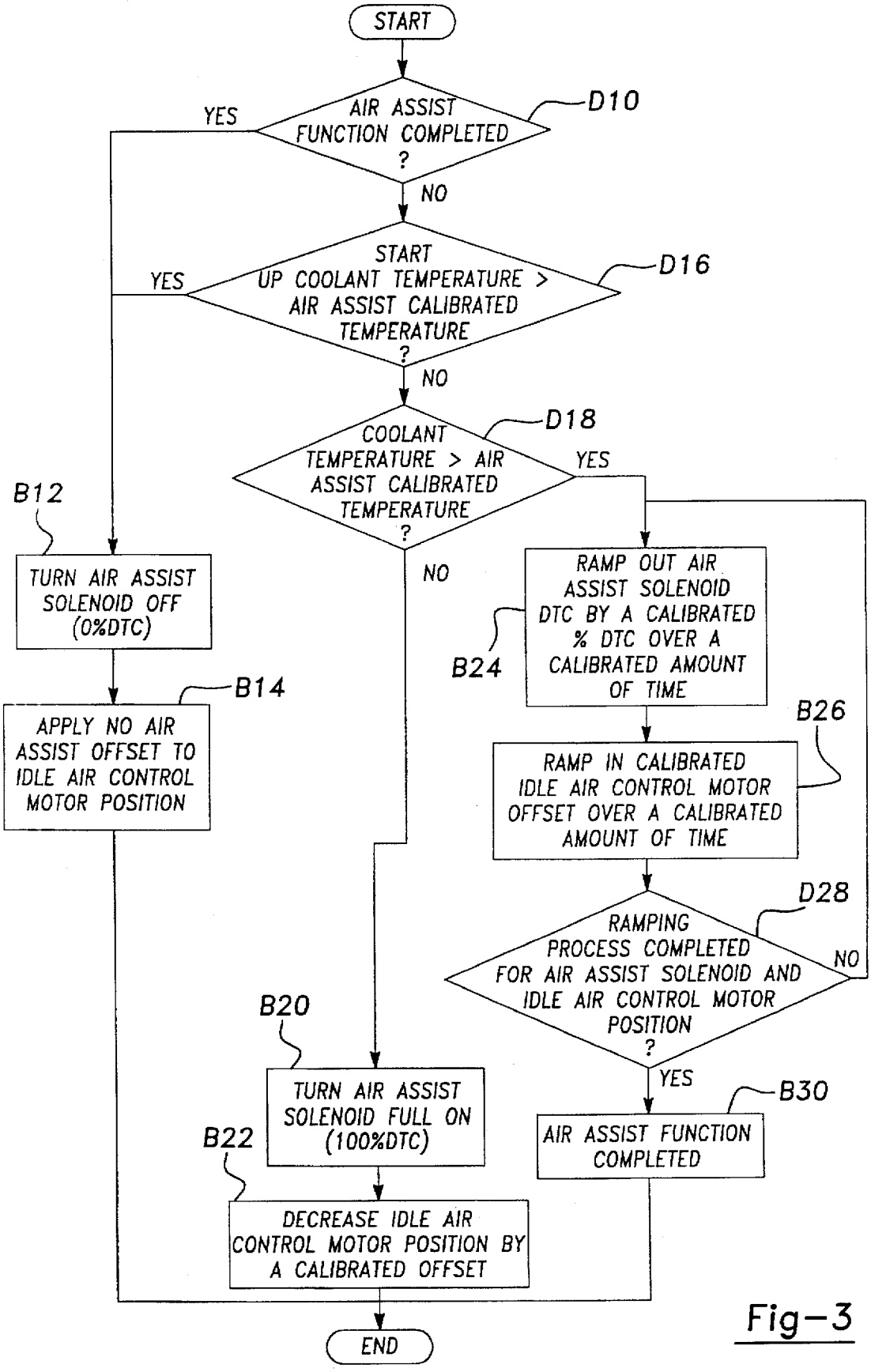
FIG. 3 is a flow chart depicting a control strategy for a bi-modal air assist injection system according to the present invention.

The control strategy for switching the solenoid 22 from an open mode to a closed mode, as well as for adjusting the volume of air permitted to flow through the primary air passage 12, is executed in the engine controller 24. As best seen in FIG. 3, in decision block D10, the engine controller 24 checks at start up to determine if an air assist function has been completed. If the air assist function has been completed, the solenoid 22 is switched to a closed mode at block B12 and is operated at a 0% duty cycle. Additionally, no variation of the idle air control motor 16 (or pintle 39) is made at block B14.

If the air assist function has not been completed, the engine controller 24 checks the signal from the engine coolant temperature sensor 26 at decision block D16 to determine if the start-up coolant temperature has reached or exceeded a predetermined calibrated temperature. If the start-up temperature is greater than or equal to the calibrated coolant temperature value, a control signal is sent to the solenoid 22 in the form of a pulsed width modulated signal representing 0% duty cycle or Full Off. Accordingly, no increased volume of air is directed to the injector tips 102 via the solenoid 22. Additionally, there is no modification to the position of the automatic idle speed motor pintle 39 to compensate for the air flowing through the injector tips 102. Thus, the solenoid 22 is kept in a closed mode and no variation of the idle air control motor 16 or pintle 39 is made at block B14.

On the other hand, if the start-up coolant temperature is less than the calibrated coolant temperature value, the engine controller 24 at decision block D18 continues to check with the sensor 26 to determine if the coolant temperature after start-up is greater than the calibrated temperature. If the coolant temperature is less than the calibrated temperature, the solenoid 22 is switched at block B20 to an open mode and operates at a 100% duty cycle. In this case, the control signal sent to the solenoid 22 is in the form of a pulse width modulated signal representing 100% duty cycle, or Full On. Simultaneously, the position of the automatic idle control motor pintle 39 is offset at block B22. This is accomplished by commanding it to close by a calibrated number of position steps to compensate for the increased amount of air passing to the engine 10 through the injector tips 102 via the solenoid 22. This compensation decreases the amount of air permitted to flow through the primary air passage 12.

When the coolant temperature at decision block D18 exceeds the calibrated coolant temperature value, the pulse width modulated signal sent to the solenoid 22 is ramped out at block B24 by a calibrated percentage of duty cycle over a calibrated amount of time to change the system from an open mode to a closed mode. Also, the position of the pintle 39 coupled to the idle air control motor 16 is ramped in at block B26 a calibrated amount of position steps of offset over a calibrated amount of time to compensate for the reduced volume of air travelling through the secondary air passage 18.

In order to smooth out any RPM fluctuations during the transition from an open mode to a closed mode, a transitional step is implemented.

During the transition step, the pulse width of the pulse width modulated signal sent to the solenoid 22 is ramped out over a calibrated period of time. This smooths the transition to a closed mode or 0% duty cycle. Simultaneously, the number of position steps previously removed from the automatic idle speed motor 16 are added back into the effective commanded pintle position a calibrated number of steps over a calibrated period of time. It should be noted that the calibrated period of time for ramping in or ramping out the automatic idle speed motor 16 and the solenoid 22 are not necessarily equal due to the differences in mechanical response.

The engine controller 24 determines at decision block D28 if the ramping process of the solenoid 22 is completed and determines if the idle air control motor pintle 39 is in a predetermined position where compensation of the closed mode of the solenoid 22 is completed. After the transition periods for both the automatic idle speed motor 16 and the solenoid 22 have elapsed, the duty cycle for the solenoid is at 0% and any position adjustments have been removed from the automatic idle speed motor 16. At this point, the air assist function is deemed complete and the mode of operation is in a closed mode. However, if the idle air control motor 16 is not in the predetermined position, ramping in of the idle air control motor 16 is continued at block B26 until the aforementioned condition is reached. Also, ramping out of the pulse width modulated signal to the solenoid 22 is continued at block B24 until the solenoid 22 is in a closed mode.

Referring again to FIGS. 1 and 2, when the system 1 is in an open mode, air enters the first section 44 of the air inlet channel 42 and passes through the first coupler 56. A relatively small portion of the air travels through the bypass section 54 while a majority of the air continues through the second section 42 to the solenoid 22. From the solenoid 22, the air travels through the first section 66 of the outlet channel system 68 and to the second coupler 72. At the second coupler 72, the air from the first section 66 merges with any air exiting from the bypass section 54. The air flows from the second coupler 72 through the second section 78 of the outlet channel system 68 to the third coupler 80. At the third coupler 80, the air is routed between a plurality of delivery channels, as represented by the first and second delivery channels 86, 90. The air is directed to the passages 94 in the engine 10 from the delivery channels 86, 90 and into the shrouds 100 surrounding the injector tips 102.

At the same time, air is continuously flowing through the primary air passage system 12. In the primary air passage system 12, the air travels from the air cleaner 28 through the first section 32 to the bypass and the throttle housing 34. The air flows around the throttle plate 36 at a controlled volume depending on the position of the throttle plate 36. The air flows through they bypass at a given volume controlled by the idle air control motor 16, pintle 39, and the engine controller 24. The air continues through the second section 40 of the primary air passage 12 to the intake port 14 of the engine 10.

The injector 20 pulses fuel into the combustion chamber 108 upon receiving a given signal from the engine controller 24. The additional volume of air introduced at the injector tip 102 via the solenoid 22 serves to increase the atomization of the fuel injected into the combustion chamber 108. The atomized fuel combines with air from the primary air passage 12 and is combusted in a known manner.

In a closed mode, air enters the first section 44 of the secondary passage 18 and flows to the first coupler 50. In this mode, the air is only permitted to flow through the bypass section 54 at a relatively reduced volume since the solenoid 22 is closed. From the bypass section 54, the air flows through the second coupler 72 and to the second section 78. The sequence then continues as described above with reference to open mode operation. As mentioned above, a reduced volume of air is permitted to flow to the injectors 20 through the secondary air passage 18 in a closed mode than in an open mode due to the arrangement of the bypass section 54.

It should be noted that the idle air control motor 16 operates to vary the volume of air passing through the primary air flow passage 12 upon receiving predetermined signals from the engine controller 24 indicating that different control loads have been placed on the engine 10. For instance, the engine controller 24 compensates for inputs indicating that the air conditioner has been turned on or that the power steering pump is being activated. In the present invention, the engine controller 24 compensates differently for control loads placed on the engine 10 according to the routing of air flow through the primary and secondary air passages 12, 18. To accomplish this, the engine controller 24 ascertains the volume of air required to flow through the primary and secondary air passages 12 and 18 for a given circumstance and establishes proper routing through the bypass, throttle housing 34, and solenoid 22. In this way, the engine controller 24 operates to prevent changes in speed from desired RPM levels when different loads are placed on the engine 10.

Thus, it can be appreciated that the present invention provides increased atomization of fuel at the injector tips. Also, the present invention provides lower levels of hydrocarbon and carbon monoxide emissions. Furthermore, the complexity and expense of prior art systems is alleviated.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for controlling air flow in an internal combustion engine comprising:

a primary air passage including a throttle valve for controlling a volume of air passing therethrough and an idle air duct bypassing said throttle valve;

an idle air pintle disposed in said idle air duct for controlling a volume of air passing therethrough;

a secondary air passage for directing assist air to at least one fuel injector tip;

an air assist valve variable between an open mode and a closed mode disposed on said secondary air passage;

an air bypass circuit coupled at a first end upstream of said air assist valve and coupled at a second end downstream of said air assist valve for providing an alternate air channel independent of said air assist valve; and an engine controller electronically communicating with said air assist valve for varying said air assist valve between said open mode and said closed mode, said variation to said open mode including ramping up a pulse width modulated signal sent to said air assist valve by a calibrated percentage of duty cycle as a function of a predetermined amount of time to controllably move said air assist valve from said closed mode to said open mode and ramping out a position of said idle air pintle a preselected number of position steps of offset over a second predetermined amount of time to compensate for an additional volume of air passing through said secondary air passage, and said variation to said closed mode including ramping out said pulse width modulated signal sent to said air assist valve by a second calibrated percentage of duty cycle as a function of a third predetermined amount of time to controllably move said air assist valve from said open mode to said closed mode and ramping in said position of said idle air pintle a second preselected number of position steps of offset over a fourth predetermined amount of time to compensate for a reduced volume of air passing through said secondary air passage.

2. The apparatus of claim 1 further comprising a coolant temperature sensor electronically communicating with said engine controller for prompting said engine controller to vary said air assist valve between said open mode and said closed mode.

3. The apparatus of claim 1 wherein said bypass is interposed between an air inlet channel and an air outlet channel of said secondary air passage.

4. The apparatus of claim 1 wherein said air assist valve comprises a solenoid.

5. The apparatus of claim 1 further comprising a plurality of air delivery channels interconnecting said secondary air passage and a plurality of fuel injectors.

6. The apparatus of claim 1 further comprising a plurality of shrouds including at least one passage therein interconnecting a plurality of fuel injectors and said secondary air passageway.

7. A bimodal air-assist fuel injection system for an internal combustion engine comprising:

a primary air passage including a throttle valve for controlling a volume of air passing therethrough and an idle air duct bypassing said throttle valve;

an idle air pintle disposed in said idle air duct for controlling a volume of air passing therethrough;

a secondary air passage for directing assist air to at least one fuel injector tip;

an air assist solenoid variable between an open mode to permit air flow therethrough and a closed mode to prevent air flow therethrough disposed on said secondary air passage;

a plurality of shrouds including at least one passage therein interconnecting a plurality of fuel injectors and said secondary air passageway;

an air bypass circuit coupled at a first end upstream of said air assist solenoid and coupled at a second end downstream of said air assist solenoid to provide an alternate air channel independent of said air assist solenoid to said plurality of fuel injectors;

an engine controller electronically communicating with said air assist solenoid for varying said air assist solenoid between said open mode and said closed mode;

an idle air control motor electronically communicating with said engine controller for varying a volume of idle speed control air introduced at a throttle housing; and a coolant temperature sensor electronically communicating with said engine controller for prompting said engine controller to vary said air assist solenoid between said open mode and said closed mode, said variation to said open mode including ramping up a pulse width modulated signal sent to said air assist valve by a calibrated percentage of duty cycle as a function of a predetermined amount of time to controllably move said air assist valve from said closed mode to said open mode and ramping out a position of said idle air pintle a preselected number of position steps of offset over a second predetermined amount of time to compensate for an additional volume of air passing through said secondary air passage, and said variation to said closed mode including ramping out said pulse width modulated signal sent to said air assist valve by a second calibrated percentage of duty cycle as a function of a third predetermined amount of time to controllably move said air assist valve from said open mode to said closed mode and ramping in said position of said idle air pintle a second preselected number of position steps of offset over a fourth predetermined amount of time to compensate for a reduced volume of air passing through said secondary air passage.

8. The apparatus of claim 7 wherein said plurality of shrouds substantially surround at least a tip of said plurality of injectors.

9. The apparatus of claim 7 wherein said bypass circuit is interposed between an air inlet channel and said air outlet channel of said secondary air passageway.

10. A method of controlling air flow in an internal combustion engine comprising:

detecting a coolant temperature; and changing a secondary air passage communicating with a plurality of fuel injectors to an open mode by varying a volume of air permitted to flow therethrough if said coolant temperature is less than or equal to a predetermined temperature, said variation to said open mode including ramping up a pulse width modulated signal sent to said air assist valve by a calibrated percentage of duty cycle as a function of a predetermined amount of time to controllably move said air assist valve from said closed mode to said open mode and ramping out a position of said idle air pintle a preselected number of position steps of offset over a second predetermined amount of time to compensate for an additional volume of air passing through said secondary air passage.

11. The method of claim 10 further comprising changing said secondary air passage to a closed mode by varying a volume of air permitted to flow therethrough if said coolant temperature is greater than a given temperature, said variation to said closed mode including ramping out said pulse width modulated signal sent to said air assist valve by a second calibrated percentage of duty cycle as a function of a third predetermined amount of time to controllably move said air assist valve from said open mode to said closed mode and ramping in said position of said idle air pintle a second preselected number of position steps of offset over a fourth predetermined amount of time to compensate for a reduced volume of air passing through said secondary air passage.

12. A method of controlling air flow in an internal combustion engine comprising:

detecting a coolant temperature;

converting a secondary air passage communicating with a plurality of fuel injectors to an open mode by varying a volume of air permitted to flow through a solenoid disposed on said secondary air passage a calibrated amount over a preselected period of time if said coolant temperature is less than or equal to a predetermined temperature;

said variation to said open mode including ramping up a pulse width modulated signal sent to said air assist valve by a calibrated percentage of duty cycle as a function of a predetermined amount of time to controllably move said air assist valve from said closed mode to said open mode and ramping out a position of said idle air pintle a preselected number of position steps of offset over a second predetermined amount of time to compensate for an additional volume of air passing through said secondary air passage;

converting said secondary passage to a closed mode by varying a volume of air permitted to flow through said solenoid disposed on said secondary air passage a predetermined amount over a second calibrated period of time if said coolant temperature is greater than a given temperature;

said variation to said closed mode including ramping out said pulse width modulated signal sent to said air assist valve by a second calibrated percentage of duty cycle as a function of a third predetermined amount of time to controllably move said air assist valve from said open mode to said closed mode and ramping in said position of said idle air pintle a second preselected number of position steps of offset over a fourth predetermined amount of time to compensate for a reduced volume of air passing through said secondary air passage; and adjusting a volume of air permitted to pass through a throttle housing bypass disposed on a primary air passage communicating with at least one combustion chamber a known amount over a third calibrated period of time when said secondary air passage is converted to one of said open and closed modes.

* * * * *